United States Patent [19]

Gordon

[11] 4,037,633

[45] July 26, 1977

[54] HINGED HANDBAG HANDLE APPARATUS

[75] Inventor: Michael Gordon, New York, N.Y.

[73] Assignee: Koret, Inc., New York, N.Y.

[21] Appl. No.: 745,230

[22] Filed: Nov. 26, 1976

[51] Int. Cl.[2] ..... A45C 13/26

[52] U.S. Cl. ..... 150/33

[58] Field of Search ..... 150/12, 33; 190/57, 190/58 R, 58 A, 58 B; 224/27, 45 P, 46 R, 47

[56] References Cited

U.S. PATENT DOCUMENTS

| | | | |
|---|---|---|---|
| 1,639,574 | 8/1927 | Reiter | 150/33 |
| 2,155,801 | 4/1939 | Reiter | 150/33 |
| 2,914,105 | 11/1959 | Kushynski | 150/33 |
| 3,613,759 | 10/1971 | Collings | 150/33 X |

*Primary Examiner*—Donald F. Norton

*Attorney, Agent, or Firm*—Arthur L. Plevy

[57] ABSTRACT

There is disclosed a hinged member which is adapted to be positioned on an inner flap of a handbag or similar apparatus. The hinged member is adapted to coact with a chain or handle to enable a user to carry the bag by means of the handle or carry the same by means of a chain about the shoulder of the user. In a closed position the user upon operation of the hinge, can cause the chain or handle to be placed inside the bag and hence utilize the bag as a clutch bag or remove the handle or chain entirely. The hinged member according to this invention and as positioned on the flap of the bag, is virtually hidden from view during normal use to maintain a desired and aesthetic overall appearance for the handle.

10 Claims, 7 Drawing Figures

HINGED HANDBAG HANDLE APPARATUS

BACKGROUND OF INVENTION

This invention relates to handbags in general and more particularly to a hinge apparatus associated with a handbag or similar device to enable a user to carry the bag by means of a handle or as a clutch bag according to the operation of the hinged device.

As is known, there presently exists a wide variety of styles and designs for women's handbags. Many of such devices employ handles which are integral with the bag and may be used during the day and so on for purposes of shopping and general activities. As is well known, certain of these bags employ relatively small or short handles, while others employ chains or straps to enable a woman to carry the bag or wear it about her shoulder.

Another category of bags are sometimes referred to as clutch bags. While a handbag of any type has great utility, it is commonly known that clutch bags are used for evening wear or with more formal dress.

In any event, the size and shape of such bags can vary greatly and in many instances, it is extremely desireable to use a handbag with a handle or as a clutch device in an easy and convenient manner. Apart from aesthetic reasons, there is a further aspect regarding security. Many women while employing a handle or a shoulder strap with a bag, would be well advised to actually clutch or carry the bag at certain times during the course of the day to prevent injury to her person in the event of an attempt theft and so on.

Therefore, while the problems and uses of handbags may depend on the preference of a user, it would be extremely desireable to provide a handbag or similar apparatus which possesses an easy and simple means of employing a handle or chain when desired and to use the bag or device as a clutch bag at other times.

The apparatus preferably should not detract from the overall aesthetic appearance of the bag and should be simple and easy to operate.

While the concept of providing removable handles and so on in conjunction with such bags is known in the art, such devices do not lend themselves to a simple and rapid conversion from one mode to the other, while other devices serve to detract from the overall appearance of the bag.

It is therefore an object of the present invention to provide a hinged mechanism which is operative in a first mode to accommodate a chain or handle associated with the bag and in a second mode to enable a user to actually place the chain or handle in the inner confines of the bag by positioning the hinged mechanism in this second mode.

The hinged apparatus to be described further permits the easy removal of an associated handle or chain and can be pivoted in such a manner as to be hidden from view when desired. The apparatus therefore serves to offer a user a greater choice of freedom in employing a handbag than typical prior art devices.

BRIEF DESCRIPTION OF PREFERRED EMBODIMENT

A bag having an inner compartment formed between side walls, a back and a front wall and a bottom wall with an open top communicating with said compartment and a cover member for covering said open top, in combination therewith apparatus for enabling a user to carry said bag in a first and a second mode, comprising a first selectively pivotable hinge member coupled to said cover member on a right end of the inner surface and positioned to overlie said open top when said cover member is closed, a second selectively pivotable hinge member coupled to said cover member on a left end of the inner surface and positioned to overlie said open top when said cover member is closed, handle means coupled between said first and second hinge members and operative to enable said user to carry said bag during a first selectively pivotable position of said hinges where said handle means extend from and support said bag, said hinge members pivotable in a second position to enable said handle means to be positioned within said compartment to obscure the same in said second position to enable carrying said bag as a clutch apparatus in said second position, whereby when said cover member is closed, said hinge and handle means are obscured from view.

DETAILED DESCRIPTION OF FIGURES

Figure 1:
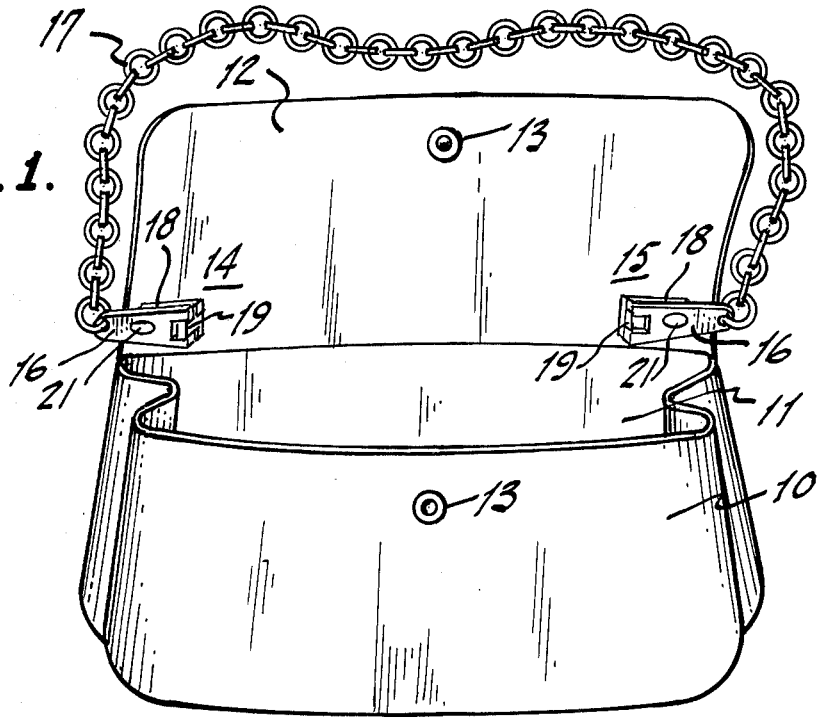
FIG. 1 is a prespective plan view of a handbag incorporating hinged apparatus according to this invention.

Referring to FIG. 1, there is shown a typical handbag 10. It is understood that the configuration for the bag 10 is merely intended to be generic and such bags as 10 can be accommodated in various shapes, sizes and materials.

Normally associated with a bag 10 is a container carrying hollow compartment 11, which enables a user to carry and transport whatever items are desired. The comparment 11 can be secured or closed by means of a flap or cover member 12, which may be selectively secured to the bag 10 by means of a number of suitable fasteners as 13.

Hence, a greater number of bags as ladies' handbags and other similar devices as attache cases, file carriers and so on are of the general configuration depicted and possess a flap or cover for closure of the same.

Shown located on the inner portion of the flap 12 are right and left hinge members 14 and 15. The hinge members 14 and 15 are secured to the inner portion of the flap relatively near the opening 11 and as will be explained, each have a depending section 16 for accommodating a chain or handle 17. The member 16 is pivotally secured on a base member 18 by means of a pivot or hinge joint 19. The base member 18 is secured to the flap 12. The hinge members 14 and 15 as depicted in FIG. 1, are shown in a chain or handle accommodating position, with the depending section 16 extending near the edge of the flap 12 with a chain or handle 17 secured between the hinge members 14 and 15. The depending member 16 has an aperture near the end portion for permitting the coupling of the handle or chain 17 to the hinges 14 and 15.

The position indication in FIG. 1 is a first hinge position and as will be seen, the base member 18 and the depending hinge member 16 are interlocked in this mode.

Figure 2:
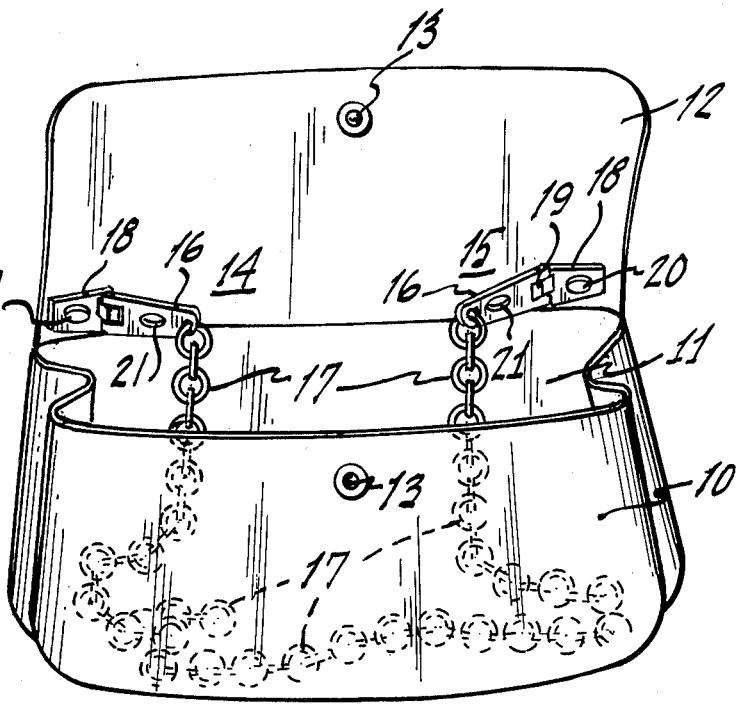
FIG. 2 is a plan view ot a handbag with the hinged apparatus positioned in a clutch carrying mode.

Referring to FIG. 2, there is shown a second mode wherein the depending hinge member 16 is pivoted with respect to the base 18 about the pivot or hinge point 19. Thus, as can be ascertained, the chain or handle 17 can be emplaced within the compartment 11 of the bag 10. The flap 12 when closed, will cause one to view the bag 10 as an ordinary clutch bag without a chain or handle as the operation of the hinge members 14 and 15 obscure both the hinges and the associated chain or handle from view in the clutch mode of FIG. 2.

While of course, the chain 17 can be removed from the member 16, it does not have to be so and the user can convert from a handle or chain carrying mode as in FIG. 1 to a clutch mode as shown in FIG. 2. This can be accommodated as often as desired and with a minimum of inconvenience and difficulty.

Figure 3:
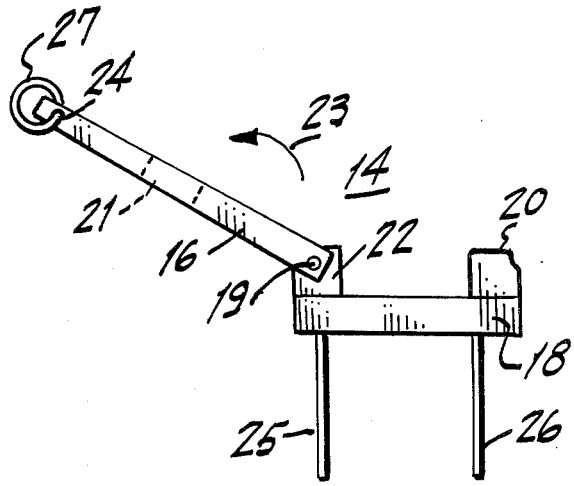
FIG. 3 is a side elevational view of a hinged member according to this invention.

Referring to FIG. 3, there is shown a side elevational view of a hinge assembly as that depicted in FIG. 1 as 14 or 15. It is again noted that the hinges 14 and 15 are relatively identical in construction but are mounted or positioned on the bag 10 in an opposite manner for functional purposes as can be ascertained upon viewing FIGS. 1 and 2.

The base member 18 is a relatively planar section and has positioned thereon a depending boss 20. The boss 20 is adapted to coact with an aperture 21 on the surface of the depending hinge member 16. The shape of the boss 20 and the aperture 21 are such that when coacting, they snap together to interlock. The base of the boss 20 is slightly larger than the top portion and the aperture 21. The aperture 21 is larger in diameter on the surface closest to the base 18 and tapers to a smaller diameter at the opposite surface. The base 18 has a pivot boss or block 22 at the other end. The block 22 has an aperture to accommodate a pivot pin 19 which couples the member 16 to member 18 permitting the pivoting of one with respect to the other as indicated by arrow 23.

Depending from the bottom surface of the base member 18 are two thin and pliable prongs 25 and 26 to enable the insertion and retention of the hinge member 14 on the flap 12 of a bag 10. As shown in FIG. 3, the member 16 is longer than the base member 18, but does not have to be so. The member 16 has an end aperture 24 which accommodates a coupling ring or loop 27 to enable a chain or handle to be emplaced via the loop 27 by any one of a plurality of coupling schemes.

Figure 4:
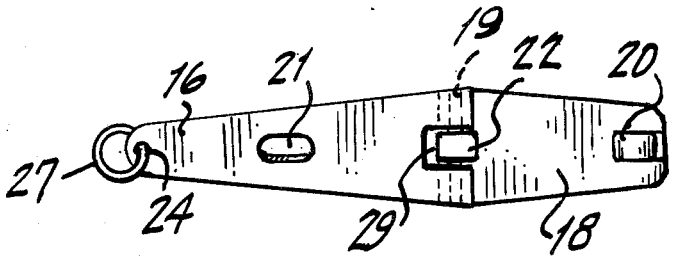
FIG. 4 is a top view of the hinged member of FIG. 3.

FIG. 4 shows a top view of the hinge with the member 16 in a complete open position. The nature of the aperture 21 is indicated more clearly to show the slight variation in diameter. The member 16 is generally planar and triangular shaped and is so selected for aesthetic purposes. The nature of the pivot joint formed is more clearly shown in FIG. 4. The member 16 has a central notch 29 at the pivot juncture which notch spans the pivot block 22 of member 18. A pivot pin 19 is directed through apertures in the side of the member 16 which communicate with the notch 29 and hence, with the aperture in the block 22 to thus form a pivotable coupling therebetween.

Figure 5:
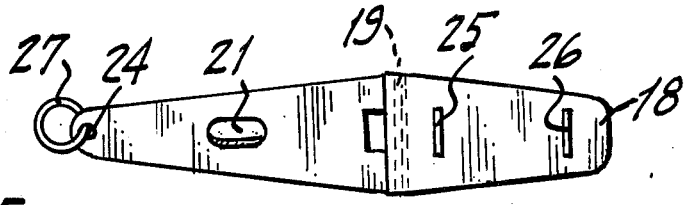
FIG. 5 is a bottom view of the hinged member.

FIG. 5 shows a bottom view of the hinge in an opened position and is presented to show the nature of the prong members 25 and 26 which are relatively thin and pliable.

Figure 6:
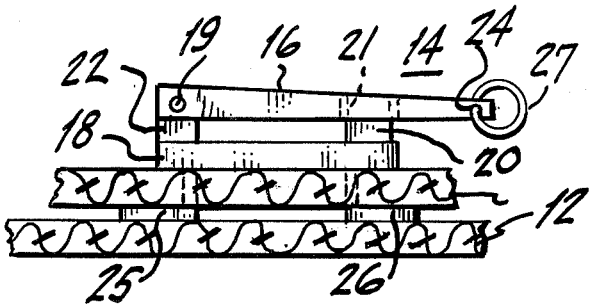
FIG. 6 is a diagrammatic view showing the hinged member coupled to the flap or closure portion of a handbag.

FIG. 6 shows the insertion of a hinge member as 14 on the flap 12 of a bag which is accommodated by the bending of the prong members 25 and 26. It is of course understood that there are many alternative ways of coupling or securing the base member 18 to an inner flap of a handbag by using conventional fastening devices and so on.

Figure 7:
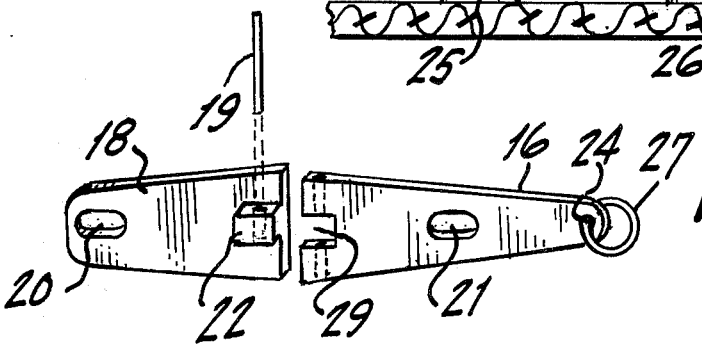
FIG. 7 is an assembly view showing the relationship of the parts comprising a hinged member according to this invention.

FIG. 7 is an assembly view to more clearly show the nature of the pivot including the pin 19. While the pivot structure depicted is extremely simple, it is of course envisioned and understood that other types of pivotable members could be employed as well as other shaped configurations for members 16 and 18 without departing from the spirit and scope of this invention which enables a user to employ a handbag in a handle carrying mode or in a clutch mode by merely altering the positions of the hinges as coupled to the inner flap of the bag to thus enable and permit the chain to be accommodated within the internal compartment of the handbag.

Thus, various modifications in regard to the overall design and the implementation of structure will become obvious to one skilled in the prior art upon reading this specification and hence it is anticipated that all such modifications shall be deemed to be encompassed within the spirit and scope of the claims appended hereto.

I claim:

1. A bag having an inner compartment formed between side walls, a back and a front wall and a bottom wall with an open top communicating with said compartment and a cover member for covering said open top, in combination therewith apparatus for enabling a user to carry said bag in a first and a second mode, comprising:

a. a first selectively pivotable hinge member coupled to said cover member on a right end of the inner surface and positioned to overlie said open top when said cover member is closed, b. a second selectively pivotable hinge member coupled to said cover member on a left end of the inner surface and positioned to overlie said open top when said cover member is closed, c. handle means coupled between said first and second hinge members and operative to enable said user to carry said bag during a first selectively pivotable position of said hinges where said handle means extend from and support said bag, said hinge members pivotable in a second position to enable said handle means to be positioned within said compartment to obscure the same in said second position to enable carrying said bag as a clutch apparatus in said second position, whereby when said cover member is closed, said hinge and handle means are obscured from view.

2. A bag having a front and back and bottom wall and side walls and an open top to form an article carrying compartment said bag including a cover member for covering said open top to close said compartment, the combination therewith of apparatus for providing a handle means to said bag, comprising:

a. first and second pivotable hinge members, positioned on the inner surface of said cover member and spaced apart one from the other and positioned to communicate with said compartment when said cover member is closed, said hinge members operative in a first position and in a second position, b. handle means coupled between said first and second hinge members and positioned by said hinges in said first position to enable said handle means to extend from and support said bag and operative in said second hinge position to enable said handle means to be positioned within said compartment to enable a user to use said bag as a clutch device in said second position with said handle means and said hinge members obscured from view when said cover member is closed.

3. The bag according to claim 2 wherein each of said hinge members comprise a base member having located thereon a pivot post, an extending arm member having an aperture at one end and pivot means at said other end adapted to coact with said post to provide a pivot juncture between said base and extending arm member, means for coupling said base member to said inner surface of said cover member.

4. The bag according to claim 3 wherein said means for coupling said base member to said cover member comprises first and second depending prongs coupled to the surface of said base member opposite to that containing said post for coupling to said cover member by a bending of said prongs.

5. The bag according to claim 3 wherein said base member includes a raised boss on a surface thereof, and said extending arm includes a relatively congruent aperture positioned to overlie said boss when said extending arm is pivoted towards said base member to cause said base member to interlock with said extending arm defining said first position for said hinge member and means coupled to said end aperture of said extending arm for coupling said handle means thereto.

6. A handbag having a front, back and bottom wall and side walls with an opened top to form an article containing compartment, and a cover flap coupled to said back wall and adapted when closed to cover said open top in combination therewith apparatus for enabling a user to carry said bag in a first and second mode, comprising:

a. a first and a second hinge means each including a base member and depending arm member pivotally coupled to said base member at one end to define a pivot juncture, said depending member having an aperture at said other end furthest removed from said pivot juncture, b. means coupling said base member of said first hinge means to an inner surface of said flap at a right hand position to enable said aperture of said depending member to extend slightly beyond said flap when pivoted towards said base member, c. means coupling said base member of said second hinge means to said inner surface of said flap at a left hand position, to enable said aperture of said associated depending member to extend slightly beyond said flap when pivoted toward said associated base member, and d. handle means coupled between said hinge means and communicating with said apertures on said depending arms to enable a user to carry said bag by said handle means when said depending arms are pivoted towards said base members, and to enable said handle means to be positioned in said compartment of said bag when said depending members are pivoted away from said associated base members, whereby when said flap is closed, said hinge and handle means are obscured from view in said second position.

7. The handbag according to claim 6 further including locking means located on said hinge members to cause depending arm to interlock with said base member when said arm is pivoted towards said base member.

8. The handbag according to claim 7 wherein said locking means includes a raised boss positioned on said base member, and a congruent aperture positioned on said depending member and adapted to encircle said boss when said depending member is pivoted towards said base member to interlock therewith.

9. The handbag according to claim 6 wherein each of said base members include two extending prongs positioned on a surface thereof for coupling said hinge means to said cover flap.

10. The apparatus according to claim 6 wherein said handle means comprises a chain member having one end link coupled to said aperture of said depending arm of said first hinge means and an opposite end link coupled to said opposite of said depending arm of said second hinge means.

* * * * *